US008316773B2

(12) United States Patent
Eches et al.

(10) Patent No.: US 8,316,773 B2
(45) Date of Patent: Nov. 27, 2012

(54) SUB-CALIBRE PROJECTILE OF THE FIN-STABILISED TYPE INCORPORATING A SABOT AND A PENETRATOR

(75) Inventors: Nicolas Eches, Vierzon (FR); Arnaud Guilloux, Morthomiers (FR); Richard Roy, Bourges (FR)

(73) Assignee: Nexter Munitions, Versailles (FR)

( * ) Notice: Subject to any disclaimer, the term of this patent is extended or adjusted under 35 U.S.C. 154(b) by 0 days.

(21) Appl. No.: 12/805,170

(22) Filed: Jul. 15, 2010

(65) Prior Publication Data

US 2011/0011297 A1 Jan. 20, 2011

(30) Foreign Application Priority Data

Jul. 20, 2009 (FR) ..... 09 03565

(51) Int. Cl.
*F42B 14/06* (2006.01)

(52) U.S. Cl. ..... 102/521

(58) Field of Classification Search ..... 102/520–523
See application file for complete search history.

(56) References Cited

U.S. PATENT DOCUMENTS 3,859,922 A * 1/1975 Kaplan et al. ..... 102/521
5,063,855 A * 11/1991 Diel et al. ..... 102/521
5,204,494 A * 4/1993 Meyer et al. ..... 102/521

FOREIGN PATENT DOCUMENTS

FR 2521717 8/1983
FR 2628196 9/1989
FR 2661739 11/1991
FR 2842897 1/2004

* cited by examiner

*Primary Examiner* — Bret Hayes
*Assistant Examiner* — Reginald Tillman, Jr.
(74) *Attorney, Agent, or Firm* — Steptoe & Johnson LLP

(57) ABSTRACT

A sub-caliber projectile of the fin-stabilized type incorporating a sabot and a penetrator linked together by shape matching linking means, said linking means incorporating a first profile machined at a bore of said sabot and cooperating with a second profile on said penetrator, each of said first and second profiles having a shape according to a section in an axial plane that alternates teeth and grooves, the axial play between one of said teeth of said penetrator and one of said grooves forming the housing of said one of said teeth in said sabot being variable along the axis of said projectile, wherein said linking means incorporate a front part (F) and a rear part (R) in which the play, at a mean temperature, between said penetrator teeth and the housings of said teeth in said sabot is variable, the play, firstly, increasing between said median zone (M) of said sabot and a front end of said sabot and, secondly, increasing between said median zone (M) of said sabot and a rear end of said sabot.

12 Claims, 2 Drawing Sheets

SUB-CALIBRE PROJECTILE OF THE FIN-STABILISED TYPE INCORPORATING A SABOT AND A PENETRATOR

This application claims the benefit of French Application No. 09.03565, filed Jul. 20, 2009.

BACKGROUND OF THE INVENTION

1. Field of the Invention

The technical scope of the invention is that of sub-caliber projectiles of the fin-stabilized type and more particularly shape matching linking means for the sabot and penetrator of such a projectile.

2. Description of the Related Art

The sabot and penetrator are generally linked together by threading, and more rarely by circular grooves.

The sabot thus incorporates a first profile machined at its bore, such profile cooperating with a second profile on the penetrator.

In any event, if a longitudinal section of the projectile is considered, each profile has a shape that alternates teeth and grooves.

It is classical to provide constant play between teeth and grooves, such play normally enables the penetrator to be screwed on when the profile are threads. This play is generally enough to enable differential dilations between the sabot (maid of several segments) and the penetrator. Indeed, the materials used for the sabot and the penetrator are very different (more often than not aluminum for the sabot and tungsten alloy for the penetrator) and also have different dilatation coefficients.

So as to enable such differential dilatations, without this resulting in a spacing of the sabot segments that would hinder the projectile's being positioned in the weapon chamber, patent FR2628196 proposes to produce threading that has a different pitch for the front and rear flanks of the threads. Such an arrangement further enables the relative axial position of the penetrator with respect to the sabot to be controlled whilst enabling differential dilatations.

Such a solution is not satisfactory, however, for present-day projectiles in which the penetrator is very long (over 700 mm). Indeed, in this case the interface between the sabot and the penetrator is also long (greater than or equal to 300 mm). However, with known solutions described by FR2628196, the support between the sabot and penetrator is made at a front part of the sabot. Because of the length of the interface, the differential dilatations become too great and the differential threading leads to the production of teeth that are too small to withstand the firing constraints.

SUMMARY OF THE INVENTION

The invention proposes a sub-caliber projectile that incorporates a sabot and penetrator linked together by shape matching linking means, projectile in which the linking means between the sabot and penetrator enable the relative sabot/penetrator position to be ensured whilst enabling the differential dilatations without any excessive reduction in the sabot/penetrator interface.

The invention furthermore enables the machining of the sabot/penetrator interface to be simplified.

The invention also relates to the sabot implemented in such a projectile.

Thus, the invention relates to a sub-caliber projectile of the fin-stabilized type incorporating a sabot and a penetrator linked together by shape matching linking means, such linking means incorporating a first profile machined at a bore of the sabot and cooperating with a second profile on the penetrator, each profile having a shape according to a section in an axial plane that alternates teeth and grooves, the axial play between one tooth of the penetrator and the groove forming its housing in the sabot being variable along the axis of the projectile, projectile wherein the linking means incorporate a front part and a rear part in which the play, at mean temperature, between the penetrator teeth and their housings in the sabot is variable, the play, firstly, increasing between a median zone of the sabot and a front end of the sabot and, secondly, increasing between the median zone of the sabot and a rear end of the sabot.

The median zone may be constituted by a median part of the sabot at which the play between the penetrator teeth and their housings in the sabot is substantially constant.

Advantageously, the median zone or part will be arranged longitudinally at a push plate of the sabot.

The median part may be of a length that is less than or equal to 30% of the full length of the sabot/penetrator interface.

According to one embodiment, the teeth and grooves of the penetrator may be of a constant width along the penetrator, the sabot alone having a median part at which the teeth and grooves are also of constant length and front and rear parts at which the teeth and grooves are of variable lengths.

The profiles may be constituted of a threading on the penetrator cooperating with internal threading on the sabot.

The width of the internal threads may thus be progressive between the median zone or part and the front and rear ends of the internal thread.

The variations in screw thread of the internal thread will be defined such that at a mean temperature of use the play is equally distributed on either side of each tooth, each penetrator tooth thus being substantially in the centre of its housing in the internal thread.

The invention also relates to a sabot intended to be incorporated into such a projectile, sabot incorporating a profile machined at a bore, such profile having a shape in a section according to an axial plane that alternates teeth and grooves and is intended to cooperate with a matching profile on the penetrator, sabot wherein its machined profile incorporates a median zone at which the teeth and grooves are of a constant width and a front and rear parts at which the widths of the teeth and grooves are variable, the width of the teeth firstly increasing between the median zone of the sabot and a front end of the sabot and secondly increasing between the median zone of the sabot and a rear end of the sabot.

The median zone or part will be advantageously positioned longitudinally at the push plate of the sabot.

The median part may be of a length that is less than or equal to 30% of the full length of the machined profile.

BRIEF DESCRIPTION OF THE DRAWINGS

The invention will become more apparent from the following description of a particular embodiment, description made with reference to the appended drawings, in which.

DETAILED DESCRIPTION OF PREFERRED EMBODIMENTS

Figure 1:
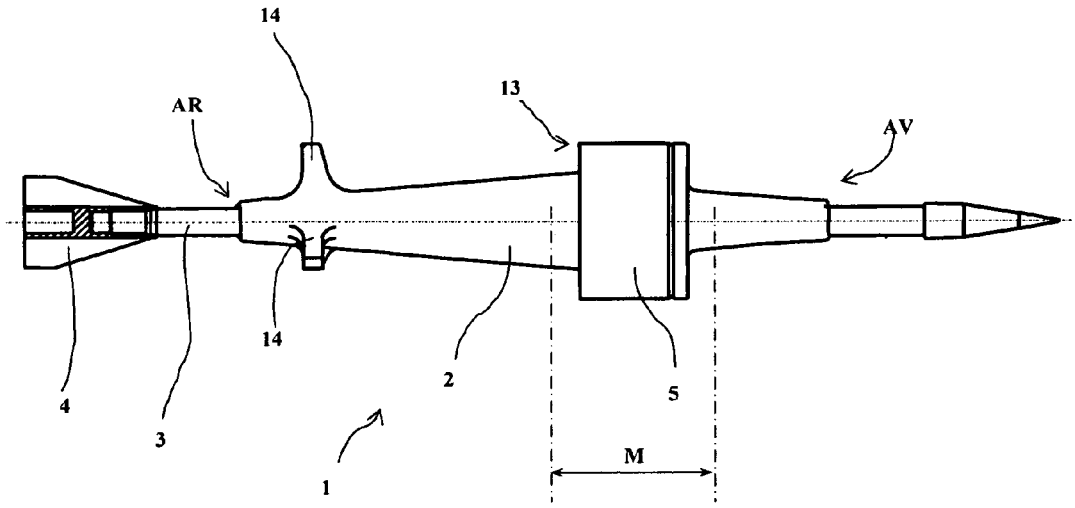
FIG. 1 is an external view of a fin-stabilized projectile.

With reference to FIG. 1, a fin-stabilized projectile 1 classically incorporates a sabot 2 made of a lightweight material (such as an aluminum alloy), the sabot being formed of several segments and surrounding a sub-caliber penetrator 3.

The penetrator is made of steel or else of a dense tungsten-based alloy.

At its rear part the penetrator is fitted with a tail piece 4 to ensure its stabilization during its trajectory.

The sabot is fitted with a band 5, made of a plastic material, that ensures gas-tightness for the propellant gases when fired from a gun barrel (not shown).

During firing, the gases from the propellant charge (not shown) namely exert their thrust on a part 13 of the sabot to the rear of the band 5, such part being caliber and constituting what is called the push plate. Simulations have shown that it is at this push plate and at its interface with the penetrator that the mechanical stresses are at their highest.

Such a general configuration for a fin-stabilized sub-caliber projectile is well known. Reference may namely be made to patents FR2521717 and FR2661739 that describe known fin-stabilized projectiles.

The sabot 2 is intended to enable a projectile to be fired from a gun. It is constituted by several segments (three, more often than not) that surround the penetrator 3 and which are in contact two by two at their joining faces.

Upon exiting the gun barrel, the segments of the sabot 2 move away from the penetrator 3 under the action of the aerodynamic forces exerted on the front part (AV) of the sabot 2.

The spacing of the segments leads to the fracturing of the band 5 and the sabot thus releases the penetrator 3 which continues on its trajectory.

Here the interface between the sabot 2 and the penetrator 3 is of substantial length (interface length of greater than or equal to 300 mm). Each sabot segment thus incorporates a rear radial arm 14. These arms 14 are of the same caliber as the gun and they provide an additional guidance support for the projectile 1 in the gun barrel. This support is placed at a distance from the rear of the band 5.

Such a general configuration of the sabot is well known to the Expert. Reference may be made, for example, to patent FR2842897 which describes such a sabot.

Shape matching means are positioned between the sabot 2 and penetrator 3 to ensure the driving of the latter.

Figure 2:
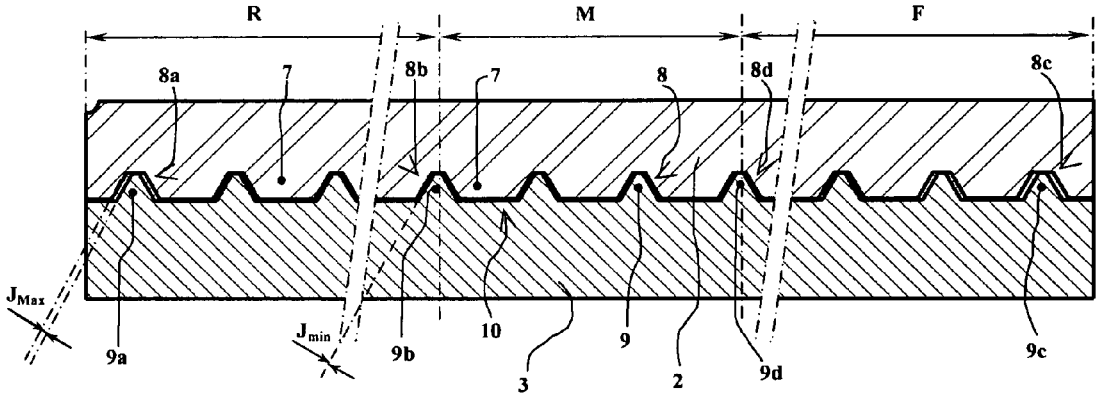
FIG. 2 is a partial longitudinal section view of sabot/penetrator linking means for the projectile according to the invention, such means being shown at a mean temperature.

FIG. 2 is a longitudinal section to display an embodiment of these drive means, such section made at a mean temperature of use (mean temperature is understood to mean the normal atmospheric temperature: around 20° C.).

The sabot 2 thus incorporates a first profile machined at a bore and cooperating with a matching profile machined on the penetrator 3.

The profiles are constituted here by threading on the penetrator 3 cooperating with internal threading made in the sabot 2.

By way of a variant, it would be possible for the threading and internal threading to be replaced by circular grooves.

Each profile has a shape in a section along an axial plane that alternates teeth and grooves.

Thus, the internal threading of the sabot 2 incorporates teeth 7 separated by grooves 8. The penetrator threading 3 incorporates teeth 9 separated by grooves 10.

The teeth 7 of the sabot 2 are positioned in grooves 10 in the penetrator and the penetrator 3 teeth 9 are housed in grooves 8 in the sabot 2.

Naturally, here we are speaking of teeth and grooves for the sake of clarity, since the section view materializes this alternation of teeth and grooves. In practical terms, on the sabot and penetrator, when the machined profiles are threading and internal threading, the different grooves of the sabot or of the penetrator are in fact a single helical groove and the different teeth of the sabot or the penetrator are in fact a single and the same helical thread.

In accordance with one characteristic of the invention, the projectile incorporates at the linking means between the sabot and penetrator a median zone or part M at which the play between the teeth 9 of the penetrator 3 and their housings 8 in the sabot 2 is substantially constant.

At this median part M a link is made by classical threading that ensures the required axial sabot/penetrator positioning.

The length of the median part M is less than or equal to 30% of the total length of the sabot/penetrator interface. This is so that the differential dilatation of the sabot/penetrator has only a negligible effect on this zone M (dilatation absorbed by the functional play).

The median part M is arranged between a front part F and a rear part R. The front part F thus extends to the front end AV of the sabot 2 and the rear part R to the rear end AR of the sabot 2. The median zone or part M is arranged longitudinally at the push plate 13 of the sabot. FIG. 1 shows the location of the median part M between two dashed-dotted lines. The play in the sabot/penetrator interface is thus minimal at that part of the interface for which the mechanical stresses are maximal during firing. During firing, any shocks that may reduce mechanical strength are thereby avoided.

Since the push plate 13 is not necessarily arranged at a zone located at an equal distance from the front and rear of the sabot, the lengths of the front F and rear R parts may thus be different.

The front F and rear R parts of the linking means differ from the median part M in that the play between the penetrator teeth and their grooves (housings) in the sabot increase between the median part M and the front or rear end of the sabot.

Thus, considering the rear part R, the play is maximal $J_{MAX}$ at tooth 9*a* located the rearmost. This play is measured between the faces of rear tooth 9*a* of the penetrator 3 and the hollow of the corresponding groove 8*a* in the sabot 2. The play is minimal $J_{min}$, however, at tooth 9*b* which is the first tooth of the rear part R.

On the contrary, considering the front part F, the play is maximal at tooth 9*c* located the foremost. This play is measured between the faces of front tooth 9*c* of the penetrator 3 and those of the corresponding groove 8*c* of the sabot 2. The play is minimal, however, at tooth 9*d* which is the first of the front part F.

Since the temperature in FIG. 2 is a mean temperature, the play is evenly distributed between the front and rear faces of the different teeth. Each tooth 9 is thus positioned in the middle of its groove 8, and this both for the front part F and for the rear part R. FIG. 2 shows the max or min play between the face of one tooth of the penetrator and a face of one groove of the sabot. The total play around a tooth is thus the double of that indicated in the Figure.

Note that each tooth 7 of the sabot 2 is located symmetrically in the middle of its groove 10 in the penetrator 3.

Figure 3:
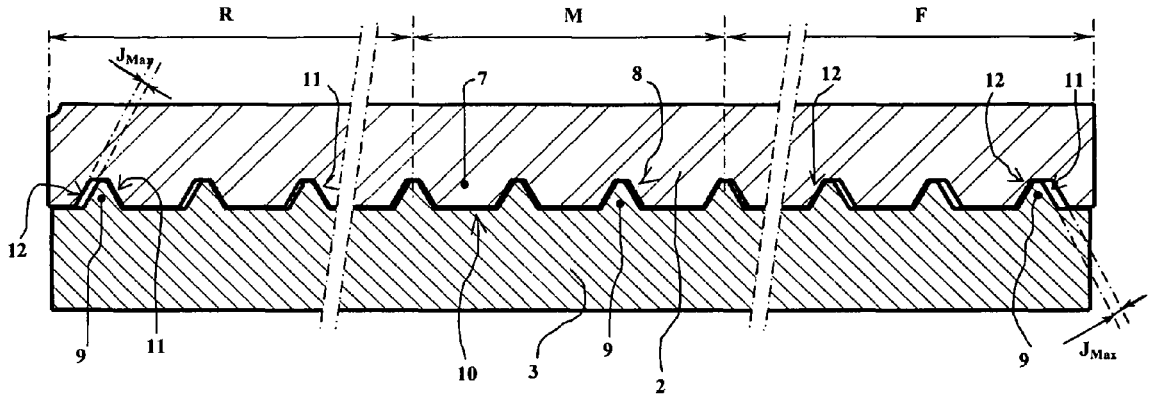
FIG. 3 is a view of the same linking means at its maximal temperature of use.

FIG. 3 shows the sabot/penetrator linking means for a maximal temperature of use (around 60° C.).

The sabot 2 is thus dilated more than the penetrator 3 and we note that the play is distributed differently. It is completely to the left of the left faces 12 of the teeth 9 in the penetrator for the rear part R and to the right of the right faces 11 of the teeth 9 of the penetrator 3 for the front part F.

The right faces 11 of the teeth 9 of the penetrator are in contact with the sabot 2 at a rear part R whereas it is the left faces 12 of the penetrator teeth 3 that are in contact with the sabot 2 at the front part F.

The progressivity of the play is selected such that all the right faces 11 of the teeth 9 and the rear part R are in contact with the sabot 2 as well as all the left faces 12 of the teeth 9 of the front part F.

The play has been selected such that, for this maximal differential dilatation, there is no opening of the sabot.

Figure 4:
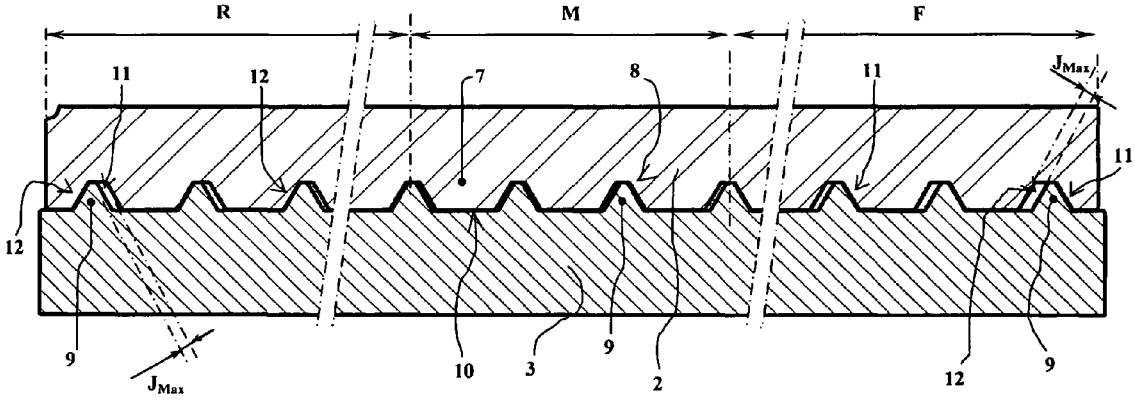
FIG. 4 is a view of the same linking means at its minimal temperature of use.

FIG. 4 shows the sabot/penetrator linking means for the minimal temperature of use (around −40° C.).

The sabot 2 is more greatly contracted than the penetrator 3 and we note once again a different distribution of the play, but a distribution that is contrary to that shown in FIG. 3.

The play is thus completely to the right of the right faces 11 of the teeth 9 of the penetrator for the rear part R and to the left of the left faces 12 of the teeth 9 of the penetrator 3 for the front part F.

The left faces 12 of the teeth 9 of the penetrator are in contact with the sabot 2 at its rear part R whereas it is the right faces 11 of the teeth 9 of the penetrator 3 which are in contact with the sabot 2 at its front part F.

The progressivity of the play is selected such that all the left faces 12 of the teeth 9 of the rear part R are in contact with the sabot as well as all the right faces 11 of the teeth 9 of the front part F.

The play has been selected such that, for this differential maximal contraction, there is no opening of the sabot caused by an interface between the teeth and the grooves.

With the projectile, and namely with the sabot according to the invention, the reference positioning of the sabot/penetrator is thus at the median zone M (that is to say at the push plate 13), and the behavior of the assembly further to the differential dilatation is analogous to that of two separate assemblies arranged on either side of this median zone M.

The linking means proposed thus enable projectiles of great length to be produced. Indeed, in this case, long interface lengths lead to high differential dilatations. If, as in known solutions, the sabot is positioned with respect to the penetrator at one end of the projectile (using a shim, for example), it is the full lengths of the penetrator and the sabot which are subjected to a differential dilatation in the same direction with respect to the shim. This would result in the excessive opening of the sabot segments or else in the necessity of providing excessive play in the assembly.

Thanks to the invention, each front part F and rear part R has a length that is less than half that of the total penetrator/sabot interface. The amplitudes of the dilatation are thus reduced in the same propositions and the play may likewise be reduced without any problems despite a globally greater dilatation.

The projectile according to the invention has been described with a sabot/penetrator interface in the form of threading.

It would naturally be possible to implement the invention using an interface that associates grooves and circular ribs.

The sabot/penetrator link of the projectile according to the invention is particularly easy to machine.

The penetrator 3 incorporates classical threading over its full length. There is therefore no mechanical embrittlement of the penetrator.

The sabot 2 is firstly machined with a classical tapping corresponding to that of the penetrator 3. Then the front F and rear R parts are machined using a specific tool (tap) enabling these zones to be given the required progressivity for the widths of the grooves 8.

Here, a sabot/penetrator interface has been described in which the median part is of a certain length. By way of a variant, it is naturally also possible to design a projectile in which the sabot/penetrator have a median part that is reduced to a zone formed of a single tooth.

This median tooth thus separates affront and rear part of the sabot and the play increases between this median zone of the sabot and the front and rear ends of the sabot.

What is claimed is:

1. A sub-caliber projectile of the fin-stabilized type having a sabot and a penetrator linked together by means for shape matching, said means for shape matching incorporating a first profile machined at a bore of said sabot and cooperating with a second profile on said penetrator, each of said first and second profiles having a shape according to a section in an axial plane that alternates teeth and grooves, wherein the grooves in the sabot define housings for said teeth of said penetrator, wherein said means for shape matching include a front part, a median zone and a rear part, wherein, at a mean temperature there is axial play between one of said teeth of said penetrator and one of said housings which play is variable along a longitudinal axis of the projectile, in said front part and in said rear part, and the axial play increases from said median zone of said sabot toward both a front end between and a rear end of the sabot.

2. A sub-caliber projectile according to claim 1, wherein in said median zone the play is substantially constant.

3. A sub-caliber projectile according to claim 2, wherein said median zone extends longitudinally in the axial direction of the sabot at a push plate of said sabot.

4. A sub-caliber projectile according to claim 2, wherein the median zone is of a length that is less than or equal to 30% of the full length of an interface between the sabot and the penetrator.

5. A sub-caliber projectile according to claim 2, wherein said teeth and said grooves of said penetrator are of a constant width along said penetrator, wherein the teeth and grooves of the sabot are of constant length along said median zone, wherein the teeth and grooves of the sabot are of variable lengths along the front part and along the rear part.

6. A sub-caliber projectile according to claim 1, wherein said profiles comprise threading on the penetrator cooperating with internal threading on the sabot.

7. A sub-caliber projectile according to claim 6, wherein the width of the internal threads increases progressively between said median zone and said front and rear ends of said internal threading.

8. A sub-caliber projectile according to claim 7, wherein the variations of the threads are defined such that at said mean temperature the plays are equally distributed on either side of each of said penetrator teeth, each of said penetrator teeth being substantially centered in each of said housings defined by said internal threading.

9. A sub-caliber projectile according to claim 2, wherein the median zone extends longitudinally in the axial direction of the sabot at a push plate of said sabot.

10. A sabot for incorporating into a projectile according to claim 1 and incorporating a profile machined at a bore, such profile having a shape in a section along an axial plane that alternates teeth and grooves and is for cooperating with a matching profile on the penetrator, and the sabot, whose machined profile incorporates a median zone (M) at which the teeth and grooves are of a constant width, and front (F) and rear (R) parts at which the widths of the teeth and grooves are variable, the width of the grooves first increasing between the median zone (M) of the sabot and the front end of the sabot, and second increasing between the median zone (M) of the sabot and the rear end of the sabot.

11. A sabot according to claim 9, wherein the median zone is positioned longitudinally at a push plate of said sabot.

12. A sabot according to claim 10, wherein the median zone is of a length that is less than or equal to 30% of the full length of the machined profile.

* * * * *